US011473554B2

(12) United States Patent
Ylä-Mononen

(10) Patent No.: US 11,473,554 B2
(45) Date of Patent: Oct. 18, 2022

(54) RADIAL PISTON HYDRAULIC MOTOR AND METHOD FOR CONTROLLING RADIAL PISTON HYDRAULIC MOTOR

(71) Applicant: BLACK BRUIN INC., Jyväskylä (FI)

(72) Inventor: Tero Ylä-Mononen, Jyväskylä (FI)

(73) Assignee: BLACK BRUIN INC., Jyväskylä (FI)

( * ) Notice: Subject to any disclaimer, the term of this patent is extended or adjusted under 35 U.S.C. 154(b) by 0 days.

(21) Appl. No.: 17/415,870

(22) PCT Filed: Dec. 20, 2018

(86) PCT No.: PCT/FI2018/050951
§ 371 (c)(1),
(2) Date: Jun. 18, 2021

(87) PCT Pub. No.: WO2020/128140
PCT Pub. Date: Jun. 25, 2020

(65) Prior Publication Data
US 2022/0074434 A1 Mar. 10, 2022

(51) Int. Cl.
*F03C 1/047* (2006.01)
*F03C 1/40* (2006.01)
(Continued)

(52) U.S. Cl.
CPC ..... *F03C 1/045* (2013.01); *F03C 1/047* (2013.01); *F03C 1/0425* (2013.01); *F03C 1/0435* (2013.01)

(58) Field of Classification Search
CPC ..... F03C 1/045; F03C 1/0425; F03C 1/0447; F03C 1/0431; F04B 1/0435; F04B 1/063;
(Continued)

(56) References Cited

U.S. PATENT DOCUMENTS 3,092,085 A * 6/1963 Bataille ..... F03C 1/0409 91/481
3,369,457 A * 2/1968 Guinot ..... F03C 1/045 91/16

(Continued)

FOREIGN PATENT DOCUMENTS

EP 2787166 A1 10/2014
FR 1585574 A * 1/1970 ..... F03C 1/0431

OTHER PUBLICATIONS

FR 1585574 A machine translation to English from espacenet (Year: 1970).*

(Continued)

*Primary Examiner* — Abiy Teka
*Assistant Examiner* — Michael Quandt
(74) *Attorney, Agent, or Firm* — Alston & Bird LLP

(57) ABSTRACT

A radial piston hydraulic motor comprising a box frame with a cam ring connected thereto, pistons in a piston frame and press rollers in the pistons, which press rollers can be pressed by means of the pressure of a hydraulic fluid, such as hydraulic oil, against an inner surface of the cam ring. The piston frame comprises connections between the interior space and passages, and a shutter valve is provided within each connection for controlling the hydraulic fluid flow through the connection between the passages and the interior space. The shutter valve is arranged to allow hydraulic fluid to flow from the passage into the interior space, when the pressure in the working pressure inlet passage, in the return passage and in the interior space is equal, i.e. the motor is in free-rotating state.

11 Claims, 7 Drawing Sheets

(51) Int. Cl.
*F03C 1/04* (2006.01)
*F03C 1/34* (2006.01)

(58) Field of Classification Search
CPC .... F04B 1/0443; F01B 1/0665; F01B 1/0672; F01B 31/22
See application file for complete search history.

(56) References Cited

U.S. PATENT DOCUMENTS

| | | | | |
|---|---|---|---|---|
| 3,656,299 | A * | 4/1972 | Fleury | F01B 3/0047 91/499 |
| 4,326,450 | A * | 4/1982 | Bacquie | F03C 1/047 91/487 |
| 5,558,003 | A * | 9/1996 | Bauzou | F03C 1/0447 91/492 |
| 5,836,231 | A | 11/1998 | Leinonen | |
| 6,470,786 | B2 | 10/2002 | Uski | |
| 2004/0194619 | A1 | 10/2004 | Lampinen | |
| 2014/0298982 | A1 | 10/2014 | Ryyppo | |

OTHER PUBLICATIONS

International Search Report for PCT/FI2018/050951 (ISA/FI) dated May 9, 2019 (4 pages).
Written Opinion for PCT/FI2018/050951 (ISA/FI) dated May 9, 2019 (6 pages).

* cited by examiner

RADIAL PISTON HYDRAULIC MOTOR AND METHOD FOR CONTROLLING RADIAL PISTON HYDRAULIC MOTOR

CROSS-REFERENCE TO RELATED APPLICATIONS

The present application is a national phase entry of International Application No. PCT/FI2018/050951, filed Dec. 20, 2018, which is incorporated herein by reference in its entirety.

TECHNICAL FIELD

The invention relates to a radial piston hydraulic motor and to a method for controlling a radial piston hydraulic motor.

BACKGROUND OF THE ART

In prior art there is known a radial piston hydraulic motor design in which a cam ring is connected to a box frame. The cam ring is a waveshaped structure, and pistons connected to a non-revolving piston frame can be pressed one after another against the inner surface of the waveshaped structure. Some of the pistons are in a working phase and some of them in a return phase. The supply of hydraulic fluid into the piston frame is regulated through a distributor valve, which revolves with the box frame. The piston frame is connected with the central non-revolving central shaft.

From the prior art designs, separate neutral position valves are known through which the motor can be disengaged to be in a neutral state so that the box frame and a structure associated therewith, for example, a wheel of a vehicle, can be rotated freely. The neutral position valves in accordance with the prior art are component units which are outside the structure and which, with their extra hoses and connections, increase the price of the system and slow down installation.

It is known to use a free rotation valve which may be built inside of a radial piston hydraulic motor and includes a spindle. The spindle is disposed in a spindle cavity and it is movable in the spindle cavity such that, in a free rotation situation, shoulders of the spindle block the inlet and outlet passages of working pressure. In free-rotation state, the hydraulic fluid is conducted from the pistons through bores and passages to the distribution valve and further to the free rotation valve, wherefrom the hydraulic fluid is conducted to an interior chamber.

When the motor is disengaged to be in the free-rotating state and the motor is running, it is essential that the hydraulic fluid at the pistons is removed rapidly so that the pistons may retreat inside the piston frame before press rolls of the pistons collide with a next cam of the cam ring. In the free-rotating state, all the hydraulic fluid at the pistons is trying to escape simultaneously. Thus, the amount of hydraulic fluid in the passages and channels of the distribution valve and the central shaft is increased. This causes increased hydraulic pressure inside the passages of the central shaft, the distribution valve and the piston frame, which may cause uncontrolled piston movement out of the piston frame. When the pistons move out of the piston frame, the pressure rolls of the pistons collide with the cams of the cam ring and the cam ring tries to press the pistons back inside the piston frame. Result of such accidental action is that the motor twitches and make unnecessary noises.

OBJECTIVE OF THE INVENTION

The objective of the device is to alleviate the disadvantages mentioned above.

In particular, it is an objective of the present device to provide more efficient way to disengage a radial piston hydraulic motor to be in a free-rotating state.

SUMMARY

According to a first aspect, the present invention provides radial piston hydraulic motor comprising a box frame with a cam ring connected thereto, pistons in a piston frame and press rollers in the pistons, which press rollers can be pressed by means of the pressure of a hydraulic fluid, such as hydraulic oil, against an inner surface of the cam ring, a working pressure inlet passage for the hydraulic fluid under working pressure and a return passage for the hydraulic fluid which is not under working pressure, from which passages the hydraulic fluid is conducted to distribution valve. The distributor valve comprises bores through which hydraulic fluid can be conducted into and out of passages in the piston frame and further in connection with the pistons. The motor comprises further an interior space for receiving hydraulic fluid, and a free-rotating valve arranged to disengage the motor to be in a free-rotating state and engage the motor to be in a drive-state by controlling the pressure in the working pressure inlet passage and in the return passage, and the piston frame is connected to a central shaft. Further, the piston frame comprises connections between the interior space and passages, and a shutter valve is provided within each connection for controlling the hydraulic fluid flow through the connection between the passages and the interior space. The shutter valve is arranged to allow hydraulic fluid to flow from the passage into the interior space, when the pressure in the working pressure inlet passage, in the return passage and in the interior space is equal, i.e. the motor is in free-rotating state. Springs are arranged to press the pistons and the press rollers associated therewith to a bottom position and out of contact with the cam ring.

In an embodiment of the device the shutter valve comprises a biased valve spring to hold the shutter valve in an open position, when the working pressure inlet passage is not under working pressure and/or the return passage is not under counter pressure.

In an embodiment of the device the shutter valve is arranged to be in a closed position, when the working pressure inlet passage is under working pressure and/or the return passage is under counter pressure.

In an embodiment of the device the box frame and the cam ring are revolving and piston frame and the central shaft are non-revolving.

In an embodiment of the device the box frame and the cam ring are non-revolving and piston frame and the central shaft are revolving.

In an embodiment of the device shutter valves are located between each piston and the central shaft.

In an embodiment of the device the shutter valve comprises a shutter spindle and a plug, wherein the shutter spindle is arranged to be pushed against the plug by the working pressure and/or the counter pressure for blocking the hydraulic fluid flow from the passage into the interior space.

In an embodiment of the device the number of the connections is equal to the number of the pistons.

In an embodiment of the device the free-rotating valve is provided for blocking the working pressure in the working pressure inlet passage and the counter pressure in the return passage, and for connecting said passages with each other and with interior space for equalizing the pressure in said passages and in the interior space.

In an embodiment of the device the free-rotating valve is integrated inside the radial piston hydraulic motor.

In an embodiment of the device the free rotating valve is arranged outside the radial piston hydraulic motor.

According to another aspect of the invention a method is provided for controlling a radial piston hydraulic motor according to any of the preceding claims characterized in that the method comprises step of loading a working pressure into the working pressure inlet passage (B) and a counter pressure into the return passage (A) so that the working pressure and/or counter pressure shut off the shutter valve and the hydraulic fluid is conducted to the pistons for achieving a drive state of the motor.

In an embodiment of the method the method comprises a step of unloading the working pressure and counter pressure so that the shutter valve opens and the hydraulic fluid is conducted from the pistons to the interior space, wherein springs press the pistons and the press rollers associated therewith to a bottom position and out of contact with the cam ring, whereby the radial piston hydraulic motor is rotating freely.

In an embodiment of the method the working pressure and counter pressure is unloaded by blocking the working pressure inlet passage and the return passage by the free-rotating valve.

The invention can be generally used in a radial piston hydraulic motor that includes a piston frame, a central shaft, a box frame and a distribution valve. The invention may relate to a radial piston hydraulic motor in which the box frame is revolving or to a radial piston hydraulic motor in which the box frame is in a fixed position and the central shaft is revolving.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

The following describes a radial piston hydraulic motor in which a box frame and a cam ring are revolving and a central shaft and a piston frame are non-revolving. However, the invention can be used in a radial piston hydraulic motor in which the box frame and cam ring are non-revolving and the central shaft and the piston frame are revolving. Therefore, the invention is not limited to either one of said radial piston hydraulic motors.

Figure 1:
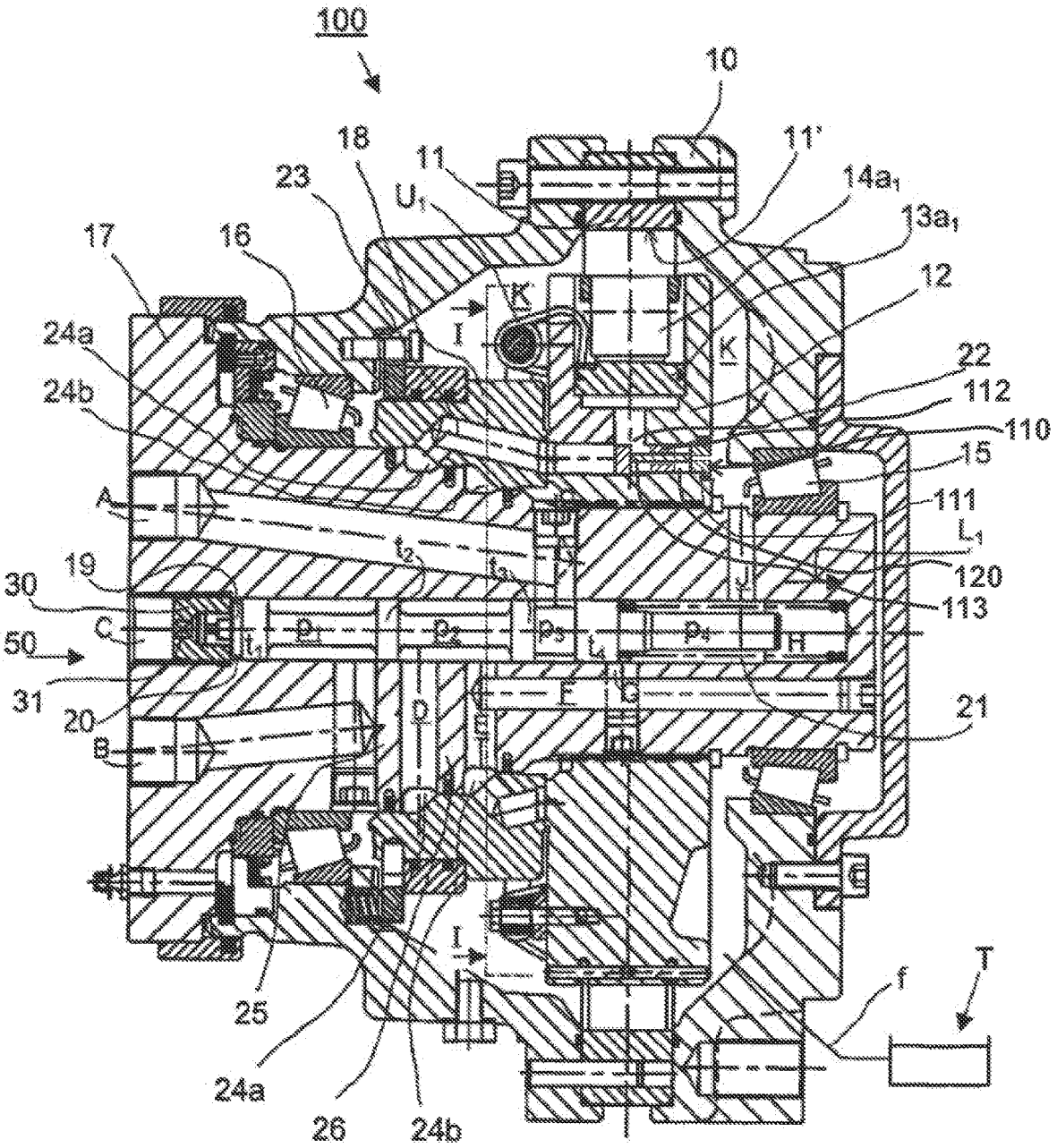
FIG. 1 shows a sectional view of a radial piston hydraulic motor in a free-rotating state.

FIG. 1 shows the radial piston hydraulic motor 100 in accordance with the invention in a free-rotating state. The main parts of the radial piston hydraulic motor 100 in accordance with the invention are described based on FIG. 1. The radial piston hydraulic motor 100 illustrated in the figure is shown as a longitudinal sectional view. The radial piston hydraulic motor 100 includes a box frame 10. A cam ring 11, revolving with the revolving box frame 10, is connected to said revolving box frame. A non-revolving piston frame 12 includes the pistons 13*a*1, 13*a*2 . . . , each piston 13*a*1, 13*a*2 including a press wheel or a press roller 14*a*1, 14*a*2 . . . , which can be pressed by means of the pressure of a hydraulic fluid, such as hydraulic oil, against an inner surface 11' of the cam ring 11. The cam ring 11 is a wave-shaped structure, so that when the piston 13*a*1, 13*a*2 . . . with its press wheel 14*a*1, 14*a*2 . . . is pressed with force against the cam ring 11, the press wheel conforms to the shape of the cam ring and thus rotates, with a desired force, the cam ring 11 and the box frame 10 associated therewith and further, for example, a wheel of a vehicle or another object to the driven.

The figure shows a bearing 15 and a bearing 16 by means of which the box frame 10 is arranged to rotate with respect to a central shaft 17. The central shaft 17 is a non-revolving shaft. A distributor valve 18 is connected to the box frame 10 and rotates therewith. The distributor valve 18 includes bores 23 from one frontal face thereof to another and further to the pistons 13*a*1, 13*a*2 . . . through passages 22 situated in the piston frame 12, which passages allow working pressure to be transferred, as desired, from a working pressure inlet passage B to the piston 13*a*1, 13*a*2 . . . which is in the working phase at each particular time and through which distributor valve 18 a hydraulic fluid, such as hydraulic oil, can be passed from the pistons 13*a*1, 13*a*2 . . . which are in the return phase to return circulation and to a return passage A.

The device comprises a free-rotating valve for disengaging the motor to be in the free-rotating state and engaging the motor to be in the drive-state. When the motor is in free-rotating state, the free-rotating valve blocks the pressure from the working pressure inlet passage B and in the return passage A and said passages are connected to each other together with internal space K. Therefore, pressure in said passages and in the internal space K is equal. In order to achieve the free-rotating state, the pistons 13*a*1, 13*a*2 . . . must be in a bottom position, so that the press wheels 14*a*1, 14*a*2 . . . of the pistons are spaced from the cam ring 11. Thus, the hydraulic fluid is removed from the pistons 13*a*1, 13*a*2 . . . via connections 120 provided in the piston frame 12 between the passages 22 and internal space K. Further, the pistons 13*a*1, 13*a*2 are assisted to the bottom position by the springs U1, U2 . . . so that the press wheels 14*a*1, 14*a*2 . . . of the pistons 13*a*1, 13*a*2 . . . separate from the cam ring 11 and the box frame 10 of the radial piston hydraulic motor 100 can be rotated freely.

The connections 120 are provided at least between some of the passages 22 and internal space K, i.e. some passages 22 are connected to the internal space K with the connections 120, and some are connected only through the free-rotating valve. Where connection 120 is provided, the hydraulic fluid is removed from the piston through said connection 120, when the motor is in free-rotating state. If no connection 120 is provided, the hydraulic fluid is removed from the piston as described later.

According to one embodiment, the connections 120 are provided between each of the passages 22 and the internal space K.

In each connection 120, a shutter valve 110 is provided for controlling the hydraulic fluid removal. The shutter valve comprises a plug 111, arranged within the connection 120, a shutter spindle 112 arranged to move away from the plug 111 and towards against the plug 111, and a valve spring 113 arranged to control the movement of the shutter spindle 112 to switch the position of the shutter valve between an open position and a closed position. When the radial piston hydraulic motor is disengaged to be in a free-rotating state, the pressure of the hydraulic fluid in the return passage A, in the working pressure inlet passage B and in the interior space K is equal, and the shutter valve changes to the open position, i.e. the biased valve spring 113 pushes the shutter spindle 112 away from the plug 111, whereby the connection between the passage 22 and the interior space K is opened and connection to the bore 23 of the distribution valve 18 from the passage 22 is blocked by the shutter spindle 112. This allows the hydraulic fluid to escape from the pistons 13*a*1, 13*a*2 . . . into the interior space K rapidly. When the radial piston hydraulic motor is engaged back to the drive-mode, the pressures in the working pressure inlet passage B and the counter pressure in the return passage A, and further in the bore 23, are increased to be greater than the pressure in the interior space K, and the shutter valve 110 is switched back to the closed position, i.e. the increased pressure in the working pressure inlet passage B and in the return passage A (and further in the passages 22) pushes the shutter spindle 112 against the plug 111 causing the connection between the passage 22 and the interior space K to be closed and, thus, blocking the hydraulic fluid from flowing from the passage 22 into the interior space K.

According to one embodiment each connection 120 is provided in the piston frame 12 between a piston (13*a*1, 13*a*2 . . . ) and the central frame 17.

According to one embodiment, the free-rotating valve is arranged inside the motor, i.e. it is integrated inside the motor.

According to one embodiment the free-rotating valve comprises a control spindle 19 placed in a spindle cavity 20 in the centre of the central shaft 17. The control spindle 19 includes shoulder portions t1, t2, t3, t4 and axial portions p1, p2, p3, p4 of a smaller cross-section between them. Around the axial portion p4 there is a spring 21, and the spindle 19 is being moved against the force of said spring by means of a pressure provided at the end of the spindle from the control pressure passage C. A passage 22 leads from each piston 13*a*1, 13*a*2 . . . to the distributor valve 18 and further in connection with the distributor valve 18 there are bores 23 opening into an annular groove 24*a* situated on the outer surface of the shaft 17. In the figure, the pressure passages are denoted with the letters B and D and the return passages are denoted with the letters E and A. The passage E is connected with an axial passage F which is connected with a passage G opening into the end of the spindle cavity 20. The passage E is a radial passage and it also opens at its end into the spindle cavity 20. Between the passages B and D there is a wall 25, a so-called partition wall. The passages B and D open into the spindle cavity 20. When the shoulder t2 of the spindle 19 is at the wall 25, the passages A and B are, so to speak, blocked with respect to each other, i.e. flow communication between them is prevented and the box frame 10 of the radial piston hydraulic motor 100 can be rotated freely. In that connection, springs U1, U2 . . . have pressed the press wheels 14*a*1, 14*a*2 of the pistons 13*a*1, 13*a*2 . . . to the bottom position, so that the press wheels 14*a*1, 14*a*2 . . . are spaced from the cam ring 11. The passages D and E and the inlet passages and return bores 23 of the distributor valve 18 then communicate in series with one another. The shoulder t3 of the spindle 19 prevents the space between the shoulders t2 and t3 from being in communication with the return passage A. The shoulder t2 prevents communication with the pressure line B. The bores 23 of the distributor valve 18 are in communication with one another through the spindle cavity 20 at the area between the shoulders t2 and t3, so that hydraulic fluid can flow from below the pistons 13*a*1, 13*a*2 . . . through the shutter valve 110 within the connections 120 and/or through the passages D, E, F, G, a space H and a passage J into the interior space K, so that the press wheels 14*a*1, 14*a*2 . . . of the pistons 13*a*1, 13*a*2 . . . , while assisted by the springs U1, U2 . . . , separate from the cam ring 11 and the box frame 10 of the radial piston hydraulic motor 100 can be rotated freely.

According to one embodiment the radial piston hydraulic motor comprises a free-rotating valve arranged outside of the motor, instead of the integrated free-rotating valve inside the motor, as described above.

When the spindle 19 is moved in the direction indicated by the arrow L1 in the figure by means of the pressure of a hydraulic fluid, such as oil, passed into the passage C against the spring force of the spring 21, the shoulder t2 of the spindle 19 is moved to a position in which the shoulder t2 is at the partition wall 26 and the working pressure inlet passage B is in communication with the hydraulic fluid passages of the working side of the distributor valve 18, and the outlets of the distributor valve 18 are further connected to the return passage A. In that connection, the pressure side B and the return side A are connected with each other through the distributor valve 18 and the pistons 13*a*1, 13*a*2 . . . The bores 23 of the distributor valve 18 provided for the pistons 13*a*1, 13*a*2 . . . which are in the working phase open into the annular groove 24*a* and the bores 23 of the distributor valve 18 provided for the pistons 13*a*1, 13*a*2 . . . which are in the return phase open into a second annular groove 24*b*. The passage C includes a plug 30 and a through-hole 31 in it for a hydraulic fluid. The plug 30 keeps the spindle 19 in the spindle cavity 20.

The inlet bores 23 of the distributor valve 18 open into the passage D, arranged in the shaft 17, and the return bores 23 thereof open into the passage E, arranged in the shaft 17. The passages D and E open into the spindle cavity 20. The axial passage F is connected with the passage E and the passage G, which extends radially in the shaft 17 and opens into the end area of the spindle cavity 20, is connected with the axial passage F. The return passage A opens into the spindle cavity 20 at the area between the passages E and G. From the interior space K of the box frame 10 there is the passage J in the shaft 17, which passage J opens into the spindle cavity 20 at the end area thereof. The spindle 19 includes the shoulders t1, t2, t3 and t4, advantageously shoulders of circular cross-section, and the smaller-diameter spindle portions p1, p2, p3, p4 between them, the cross-section of said spindle portions being advantageously circular. The spring 21 is situated around the portion p4 between the shoulder t4 and the end of the spindle cavity 20. The working pressure inlet passage B includes an end passage portion which extends radially in the shaft 17 and opens into the spindle cavity 20. The partition wall 25 is placed between it and the radially extending passage D. Between the passage E, which extends radially in the shaft 17 and opens into the spindle cavity 20, and the passage D there is also the partition wall 26.

In the device arrangement, in the drive-state of the motor, the shoulder t2 of the spindle 19 is at the partition wall 26, so that the working pressure inlet passage B of the radial piston hydraulic motor 100 communicates, through the space 20 between the shoulders t1 and t2, with the passage D, the bores 23 of the distributor valve 18 and with the pistons 13*a*1, 13*a*2 . . . which are in the working phase. The bores 23 of the distributor valve 18 and the pistons 13*a*1, 13*a*2 . . . which are in the return phase communicate with the return passage A between the passage E and the shoulders t2 and t3 via the spindle cavity 20 of the spindle 19. In the free-rotating state when the motor 100 does not drive, the springs U1, U2 . . . press the pistons 13*a*1, 13*a*2 . . . to the bottom position, so that the pressure lines A and B are blocked and the working phase and return phase bores 23 of the distributor valve 18 communicate with one another through the passages D and E and the spindle cavity 20 at the area between the shoulders t2 and t3 of the spindle 19.

The special features of the invention are described in greater detail below.

Figure 2:
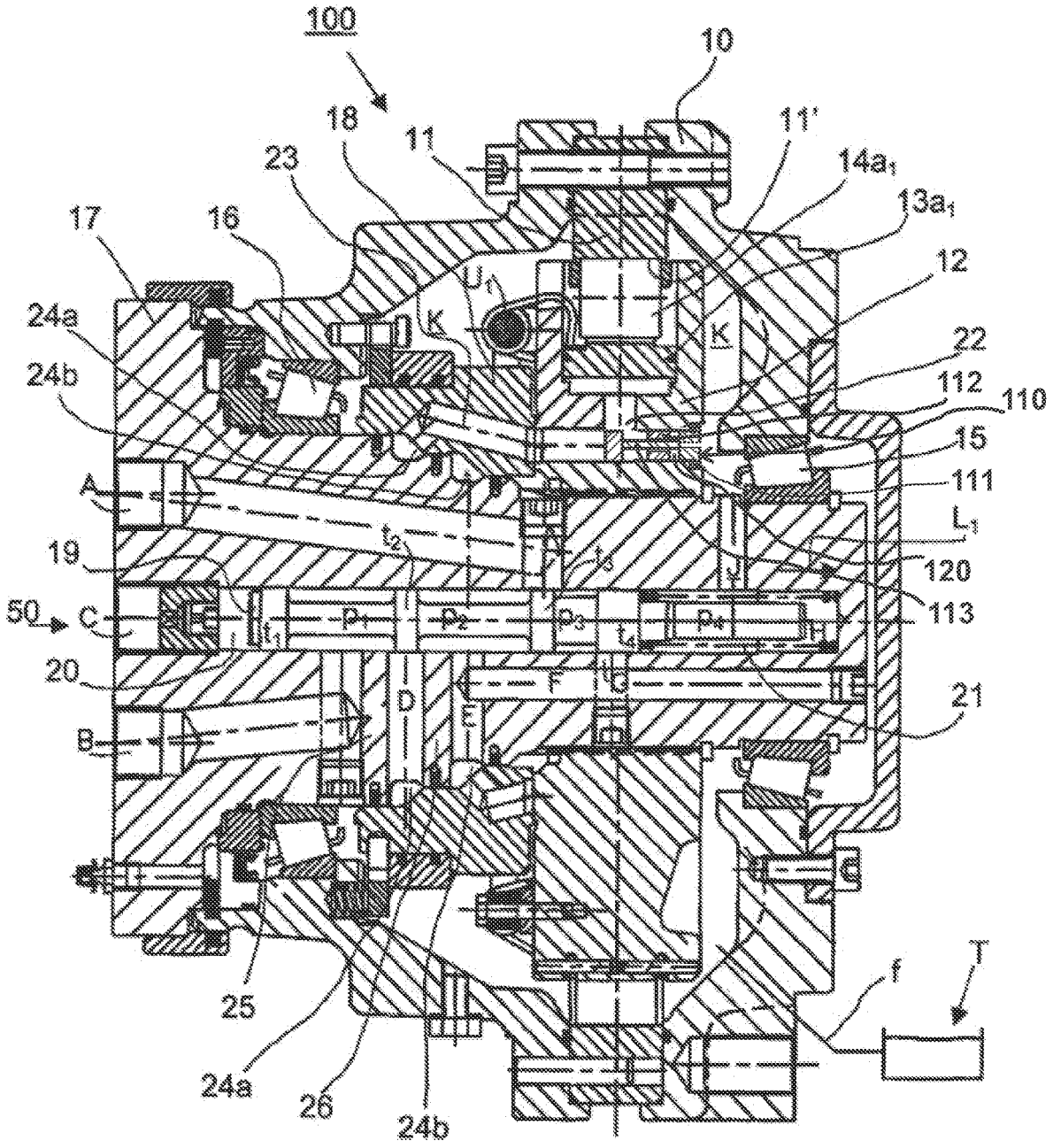
FIG. 2 shows a sectional view of a phase when the radial piston hydraulic motor is engaged to drive.

FIG. 2 shows the phase in which the radial piston hydraulic motor 100, comprising internal free-rotating valve, is engaged to drive.

When a pressure force, exceeding the compression of the spring 21, is passed to the line C, the spindle 19 is caused to move to the right. The line G closes, so that pressure cannot any more enter, from below the pistons 13*a*1, 13*a*2 . . . , the interior space K of the box frame 10. When the second shoulder t2 of the spindle 19 from the left is at the line D, the pressure is momentarily able to pass from the line B to the lines D and E, and therefrom through the distributor valve 18 again below the pistons 13*a*1, 13*a*2 . . . . Consequently, the shutter valves 110 are caused to shut off and the pistons 13*a*1, 13*a*2 . . . are caused to rise from their bottom position towards the cam ring 11. The high working pressure of the line B is momentarily lowered because at this moment there is also communication with the line A having a smaller pressure.

When the pistons 13*a*1, 13*a*2 . . . and the piston rollers 14*a*1, 14*a*2 . . . are moving towards the cam ring 11, a pressure is generated inside the box frame 10 because of the throttling action of a normal hose line f leading from the interior space K of the box frame 10 to a tank T. The pressure of the interior space K of the box frame 10 also acts through the passage J on the end of the spindle 19 at the side of the spring 21, and on the shoulder t4. In that connection, the speed of movement of the spindle 19 to the right (arrow L1) slows down because of the pressure force acting on the shoulder t4 such that high pressure peaks are not produced at any stage in the interior space K of the box frame 10. The passage J is a radial passage situated in the central shaft 17 and it opens into the interior space K of the box frame 10 and into the end of the spindle cavity 20.

Figure 3:
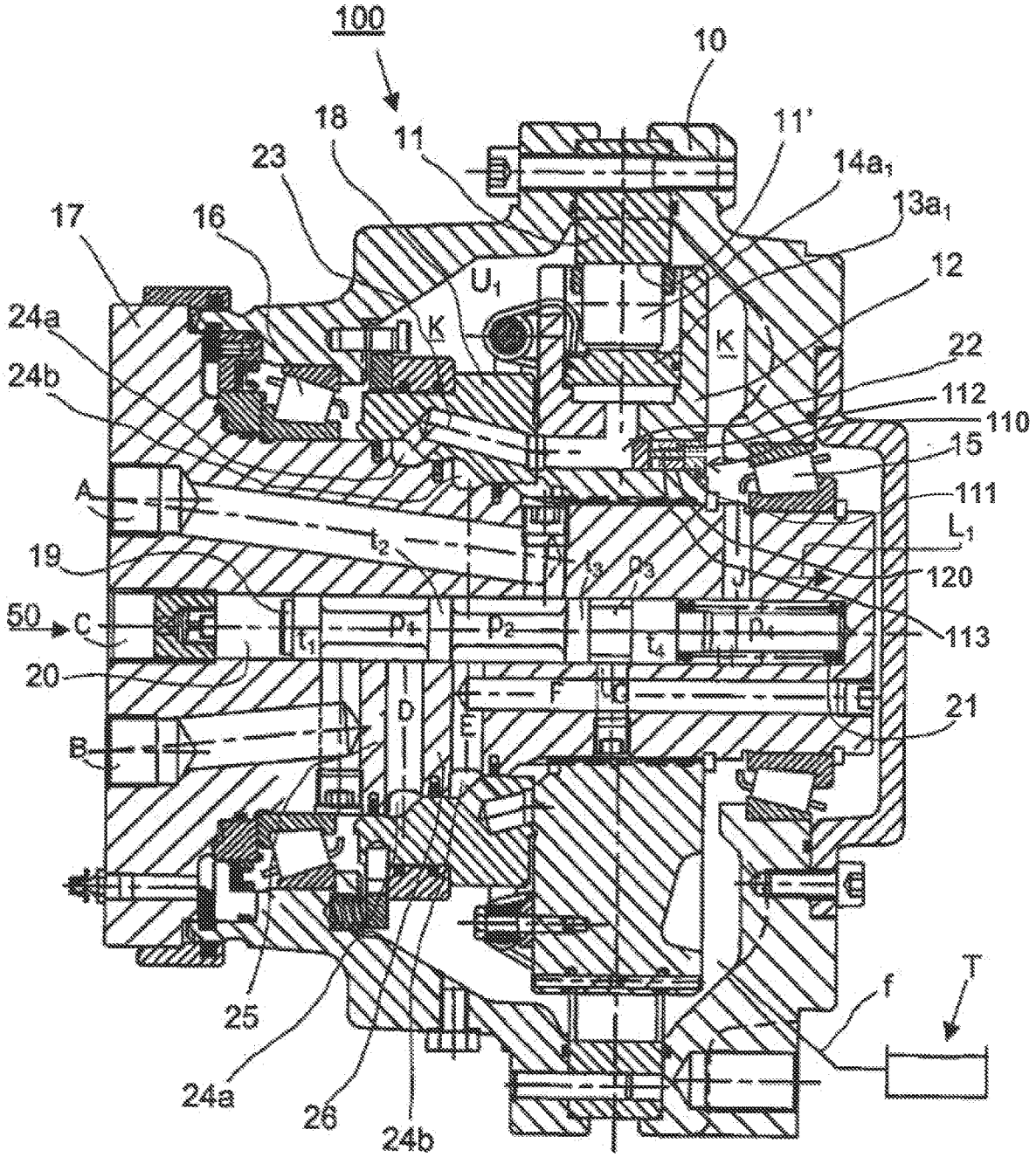
FIG. 3 shows a sectional view of the radial piston hydraulic motor is a drive state.

FIG. 3 shows a normal drive state (control pressure acts on the passage C) of a radial piston hydraulic motor comprising internal free-rotating valve.

When the piston rollers 14*a*1, 14*a*2 . . . have reached the cam ring 11, the radial piston hydraulic motor 100 is in a normal drive state. The shoulder t2 of the spindle 9 separates the pressure lines B and A as well as the passages D and E from one another. Hydraulic fluid flows from the working pressure inlet passage B through the line D to the distributor valve 18 and further under the pistons 13*a*1, 13*a*2 . . . In the return phase of the pistons 13*a*1, 13*a*2 . . . (at that time, the pistons 13*a*1, 13*a*2 . . . move towards the centre of the radial piston hydraulic motor 100), hydraulic fluid is passed from below the pistons 13*a*1, 13*a*2 . . . through the distributor valve 18 to the passage E and further to the line A. The spindle 19 is in a position in which the radial passage E opens into the space between the shoulders t3 and t4, so that pressure has access from the line E only into the passages F and G and into the space between the shoulders t3 and t4 in the spindle cavity 20. The shoulder t4 prevents pressure communication with the passage J and with the interior space K of the box frame 10.

Transition to Neutral Position

When the control pressure is removed from the line C, the spindle 19 starts to return to the left by means of the spring 21. When the spindle 19 is completely on the left (FIG. 1), hydraulic fluid is able to flow from under the pistons 13*a*1, 13*a*2 through the shutter valves 120 within the connections 120 and/or through the distributor valve 18 and the passages D and E to the passages F and G and further through the end space H of the spindle cavity 20 and through the passage J to the interior space K of the box frame 10, from where there is the box line f leading to the tank T. There is the same pressure above and below the pistons 13*a*1, 13*a*2 . . . , so that the free rotation springs U1, U2 . . . and the cam ring 11 (when revolving) are needed to press the pistons 13*a*1, 13*a*2 . . . to their bottom position. When all pistons 13*a*1, 13*a*2 . . . are in the bottom position, the motor can be rotated freely. When the direction of rotation of the radial piston hydraulic motor 100 is changed, a higher-pressure working pressure is passed to the return passage A, so that a lower-pressure return line is formed by the working pressure passage B. The operation of the radial piston hydraulic motor 100 is otherwise the same.

In the embodiments shown in the above-mentioned figures, the spindle 19 is constructed such that in a situation where no pressure is passed into the passage C, the spring 21 holds the spindle 19 in a position that provides free rotation. When control pressure is passed into the passage C, the spindle 19 is moved to a position in which a normal drive-state is provided.

Figure 4:
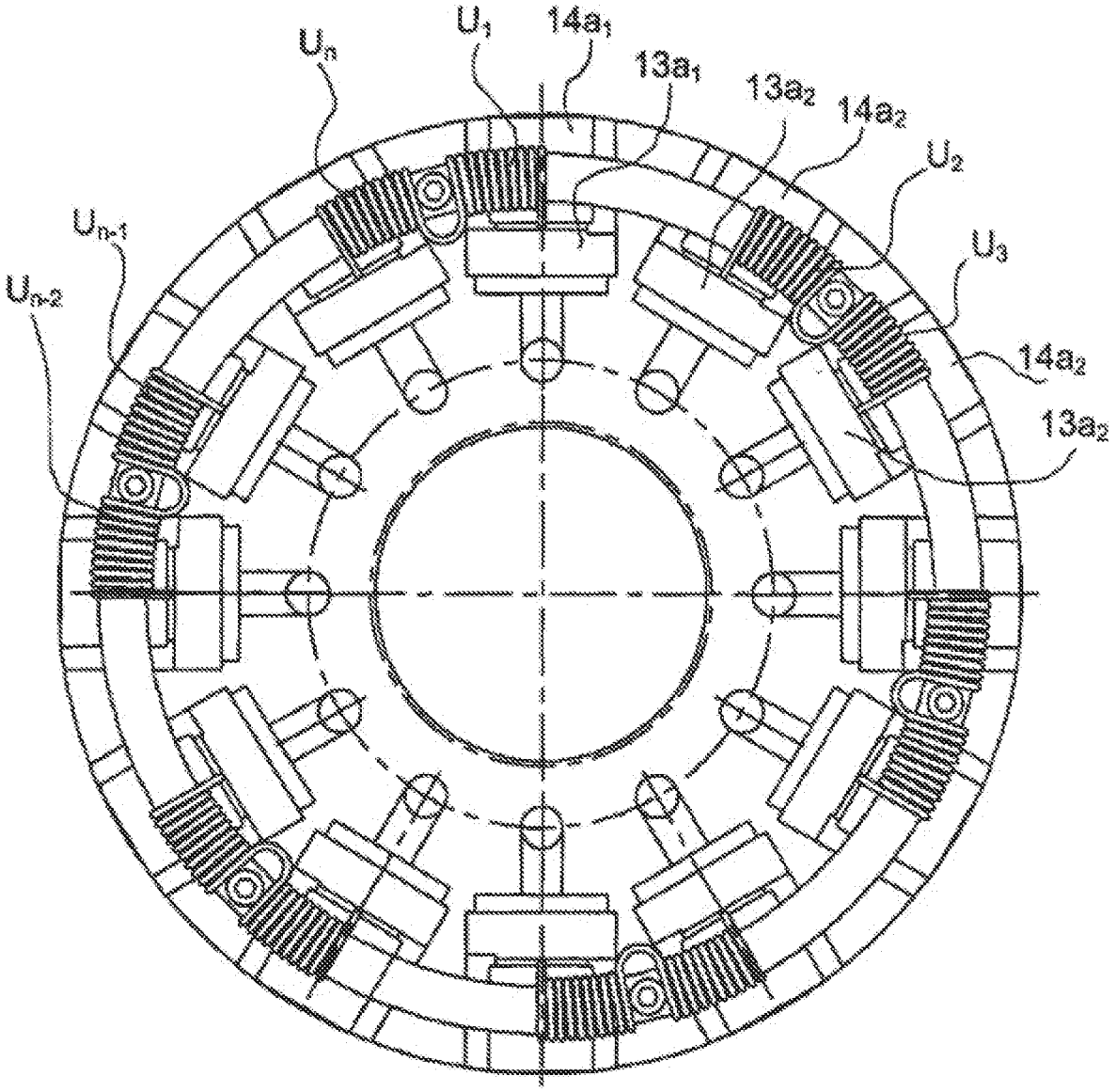
FIG. 4 shows a partial sectional view of a piston frame and springs associated with pistons.

FIG. 4 is a sectional view along I-I of FIG. 1. The figure is a partial sectional view. The piston frame 12 and the springs U1, U2 . . . associated with the pistons 13*a*1, 13*a*2 . . . are shown. The cam ring 11 and the central shaft 17 are not shown in the figure. The pistons 13*a*1, 13*a*2 . . . and the press rollers 14*a*1, 14*a*2 . . . associated with them are pressed by means of the springs U1, U2 . . . out of contact with the inner surface of the cam ring 11 in a free rotation situation.

Figure 5A:
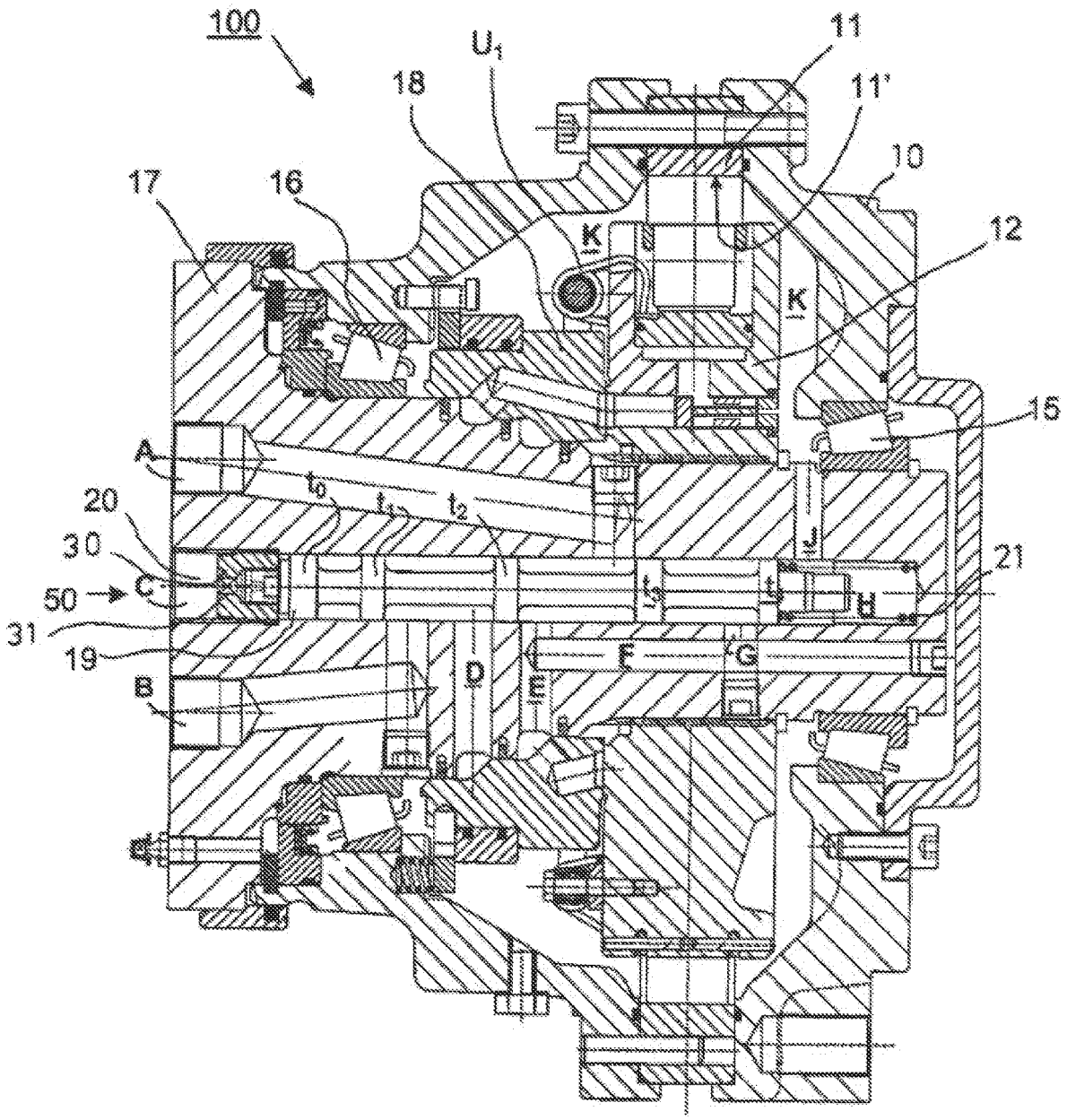
FIG. 5A shows a second embodiment of the spindle in apposition in which no control has been passed to a passage C.
Figure 5B:
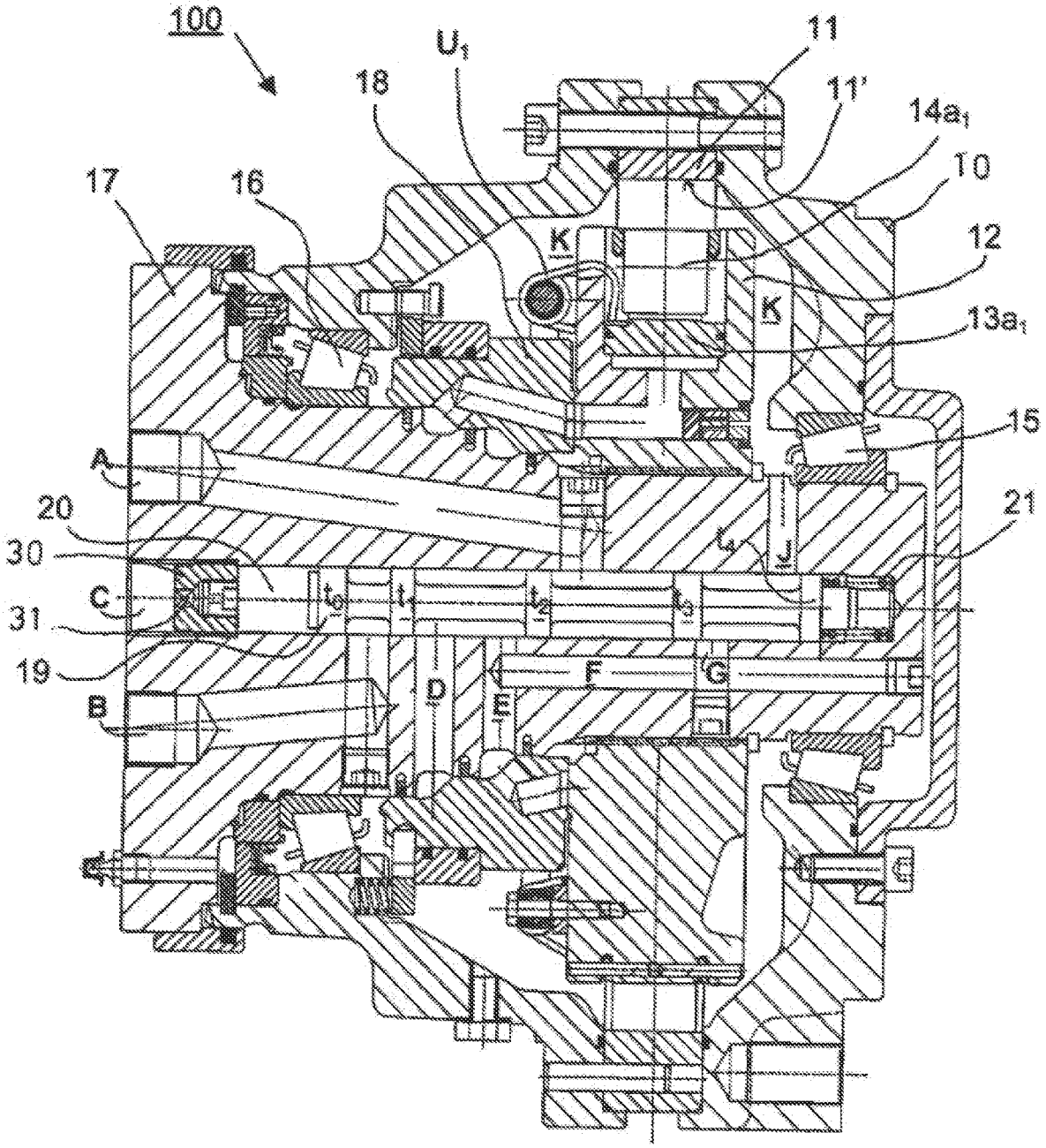
FIG. 5B shows a stage in which control pressure has been passed into the passage C and the radial piston hydraulic motor is in a free-rotating state.

FIGS. 5A and 5B show a second embodiment of the spindle 19 of the invention, the operation mode being different in the embodiment. When no control pressure is passed into the passage C, the spindle 19 is kept by means of the spring 21 in a position in which a drive-state is realized, and when control pressure is passed into the passage C, the spindle 19 is moved against the spring force of the spring 21 to a position in which a neutral position situation is realized. In the phase of FIG. 5A, no control pressure has been passed into the passage C and the spindle 19 is in a position in which a drive-state is realized, and in the illustration of FIG. 5B, control pressure has been passed into the passage C and the spindle 19 has been moved to a position in which the shoulders t1 and t2 block the pressure lines A and B and the radial piston hydraulic motor 100 is freely rotatable, i.e. in a free-rotation state.

Figure 6A:
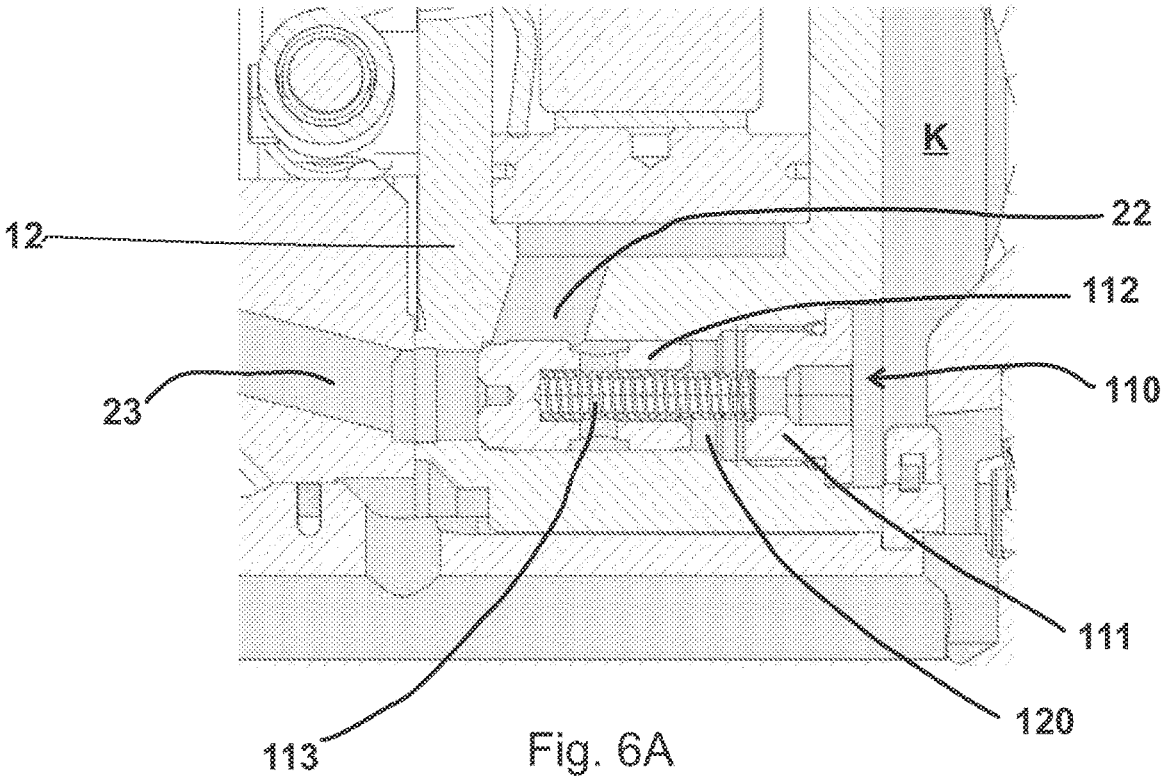
FIG. 6A shows partial sectional view of a shutter valve in an open position.

FIG. 6A shows the shutter valve 110 in open position. The working pressure is unloaded in the working pressure inlet passage B and counter pressure in the return passage A, and further in the bore 23 and the passage 22, by the free-rotating valve. Further, the said passages are also connected to the interior space K by the free-rotating valve and, thus, pressure inside the bore 23, the passage 22, and internal space K is equal. Therefore, biased valve spring 113 is pushing the shutter spindle 112 away from the plug 111 causing the connection 120 to be opened and the convection from the passage 22 into the bore 23 of the distribution valve to be blocked. Open connection 120 allows hydraulic fluid to flow from the piston, and the passage 22, into the internal space K.

Figure 6B:
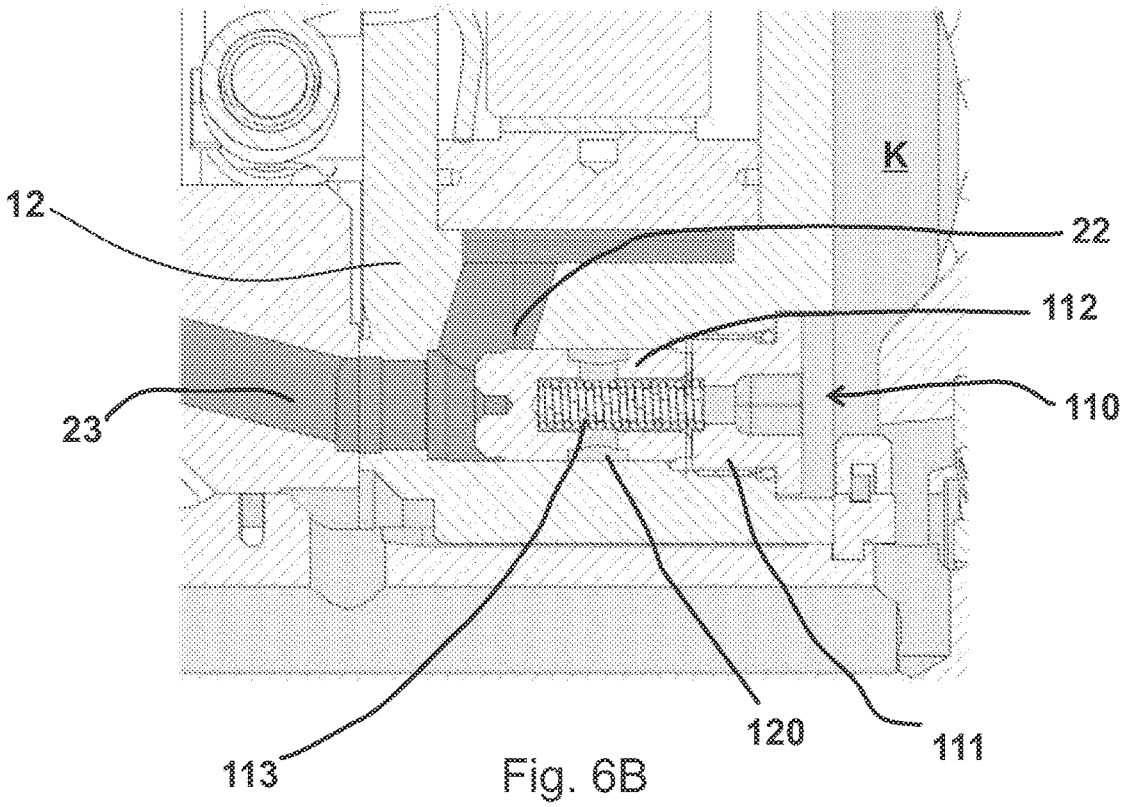
FIG. 6B shows partial sectional view of the shutter valve in a closed position.

FIG. 6B shows the shutter valve 110 in closed position. The working pressure is loaded in the working pressure inlet passage B and counter pressure in the return passage A, and further in the bores 23 and, thus, the pressure inside the bore 23 is greater than the pressure inside the internal space K. The pressure inside the bores 23 exceeds combination of the spring force of the valve spring 113 and the pressure inside the internal space K and, thus, the shutter spindle 112 is pushed against the plug 111. When the shutter spindle 112 is pushed against the plug 111, the connection 120 between the passage 22 and the internal space K is blocked. Therefore, the hydraulic fluid is not allowed to flow from the piston 13*a*1, 13*a*2 . . . , and the passage 22, into the internal space K through the connection 120. According to one embodiment, a free-rotation valve 50, built inside the radial piston hydraulic motor 100, is used in the method for control of the radial piston hydraulic motor in accordance with the invention. The free-rotation valve 50 comprises the spindle 19, which is moved in the spindle cavity 20. In accordance with the invention, the radial piston hydraulic motor 100 is controlled such that the shoulders t1 and t2 of the spindle 19 in the free-rotation state block the inlet and outlet passages A and B of the working pressure, so that in the free rotation situation the pistons 13*a*1, 13*a*2 . . . and the press rollers 14*a*1, 14*a*2 . . . associated with them are pressed by means of the springs U1, U2 . . . to the bottom position and out of contact with the cam ring 11. The radial piston hydraulic motor 100 can then be rotated freely.

Furthermore, in the method in accordance with the invention, the passages of the distributor valve 18 leading to the pistons 13*a*1, 13*a*2 . . . which are in the working phase and the passages of the distributor valve 18 leading from the pistons 13*a*1, 13*a*2 . . . which are in the return phase are connected in series in the free rotation situation and, in addition, said system of passages connected in series is connected to the interior space K of the box frame 10. Further, at least some of the passages 22 in the piston frame 12 are connected to the interior space K by connections 120. Within each of connections 120 a shutter valve is provided for controlling the hydraulic fluid flow from the pistons 13*a*1, 13*a*2 . . . to the interior space K. When working pressure and/or counter pressure is loaded into the working pressure inlet passage B and/or return passage A, the shutter valve 110 is shut off and, thus, the hydraulic fluid is not allowed to flow through the connections 120. When the working pressure and the counter pressure is unloaded, the pressures inside the working pressure inlet passage B, the return passage A and the interior space K, are equal and, thus, the shutter valve 110 is opened and the hydraulic fluid is allowed to flow from the pistons into the interior space K through the connections 120. In the method in accordance with the invention, control of the radial piston hydraulic motor 100 takes place by linearly moving the spindle 19 placed in the spindle cavity 20 of the central shaft 17.

The operation shown in FIGS. 5A and 5B can also be accomplished by the design of FIGS. 1-3 such that the spring 21 is moved to the left end of the spindle 19 shown in FIG. 1 and, correspondingly, an external control pressure is passed to the right end of the spindle 19 shown in FIG. 1. In that case, the right-hand end of the spindle 19 must be provided with an additional shoulder t for receiving pressure and a line C for supplying control pressure. When the control pressure is now passed to the right side of the additional shoulder t, the radial piston hydraulic motor 100 is disengaged to rotate freely. Without said control pressure for the right end of the spindle 19, the radial piston hydraulic motor 100 is in the normal drive-state while the spring 21 in this embodiment moves the spindle 19 to the right (arrow L1) to one extreme position of the spindle 19.

In this application, control pressure, advantageously the pressure of a hydraulic fluid, such as hydraulic oil, passed to the passage C is used for moving the spindle 19. The spindle 19 can also be moved by means of an actuator, for example, an electric motor. Within the scope of the invention, it is possible to replace the spring 21 at the end of the spindle 19, for example, with an air spring.

Although the invention has been described so that the free-rotating valve is integrated inside the radial piston hydraulic motor, it is noted that it is only one embodiment of the free-rotating valve suitable for the invention. It is equivalent to have a free-rotating valve, which is arranged outside of the motor and having corresponding connections to the passages/lines of the motor.

Although the invention has been the described in conjunction with a certain type of device, it should be understood that the invention is not limited to any certain type of device. While the present inventions have been described in connection with a number of exemplary embodiments, and implementations, the present inventions are not so limited, but rather cover various modifications, and equivalent arrangements, which fall within the purview of prospective claims.

The invention claimed is:

1. A radial piston hydraulic motor comprising:

a box frame with a cam ring connected thereto, pistons in a piston frame and press rollers in the pistons, the press rollers can be pressed by means of the pressure of a hydraulic fluid against an inner surface of the cam ring, a working pressure inlet passage for the hydraulic fluid under working pressure and a return passage for the hydraulic fluid which is not under working pressure, from the working pressure inlet passage and the return passage the hydraulic fluid is conducted to a distribution valve, the distributor valve comprising bores through which hydraulic fluid can be conducted into and out of passages in the piston frame and further in connection with the pistons, an interior space for receiving hydraulic fluid, and a free-rotating valve arranged to disengage the motor to be in a free-rotating state and engage the motor to be in a drive-state by controlling the pressure in the working pressure inlet passage and in the return passage, wherein the piston frame is connected to a central shaft, wherein the piston frame comprises connections between the interior space and the passages in the piston frame, and a shutter valve is provided within each connection for controlling the hydraulic fluid flow through the connection between the passages and the interior space, wherein each said shutter valve is arranged to allow hydraulic fluid to flow from the passage into the interior space, when the pressure in the working pressure inlet passage, in the return passage, and in the interior space are equal, wherein springs are arranged to press the pistons and the press rollers associated therewith to a bottom position and out of contact with the cam ring, and wherein the free-rotating valve is provided for blocking the working pressure in the working pressure inlet passage and the counter pressure in the return passage, and for connecting the passages in the piston frame with each other and with interior space for equalizing the pressure in said passages and in the interior space.

2. A radial piston hydraulic motor according to claim 1, wherein each said shutter valve comprises a biased valve spring to hold the shutter valve in an open position, when the working pressure inlet passage is not under working pressure and/or the return passage is not under counter pressure.

3. A radial piston hydraulic motor according to claim 1, wherein each said shutter valve is arranged to be in a closed position, when the working pressure inlet passage is under working pressure and/or the return passage is under counter pressure.

4. A radial piston hydraulic motor according to claim 1, wherein the box frame and the cam ring are revolving and piston frame and the central shaft are non-revolving.

5. A radial piston hydraulic motor according to claim 1, wherein the shutter valves are located between each piston and the central shaft.

6. A radial piston hydraulic motor according to claim 1, wherein each said shutter valve comprises a shutter spindle and a plug, wherein the shutter spindle is arranged to be pushed against the plug by the working pressure and/or the counter pressure for blocking the hydraulic fluid flow from the passage into the interior space.

7. A radial piston hydraulic motor according to claim 1, wherein the number of the connections is equal to the number of the pistons.

8. A radial piston hydraulic motor according to claim 1, wherein the free-rotating valve is integrated inside the radial piston hydraulic motor.

9. A method for controlling a radial piston hydraulic motor according to claim 1, wherein the method comprises step of loading a working pressure into the working pressure inlet passage and a counter pressure into the return passage so that the working pressure and/or counter pressure shut off the shutter valves and the hydraulic fluid is conducted to the pistons for achieving a drive state of the motor.

10. A method for controlling a radial piston hydraulic motor according to claim 9 wherein the method comprises a step of unloading the working pressure and counter pressure so that the shutter valves open and the hydraulic fluid is conducted from the pistons in to the interior space, wherein springs press the pistons and the press rollers associated therewith to a bottom position and out of contact with the cam ring, whereby the radial piston hydraulic motor is rotating freely.

11. A method for controlling a radial piston hydraulic motor according to claim 10, wherein the working pressure and counter pressure is unloaded by blocking the working pressure inlet passage and the return passage by the free-rotating valve.

* * * * *